US009537220B2

(12) United States Patent
Chang et al.

(10) Patent No.: US 9,537,220 B2
(45) Date of Patent: Jan. 3, 2017

(54) ANTENNA ASSEMBLY AND WIRELESS COMMUNICATION DEVICE EMPLOYING SAME

(71) Applicant: Chiun Mai Communication Systems, Inc., New Taipei (TW)

(72) Inventors: Tze-Hsuan Chang, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 480 days.

(21) Appl. No.: 14/081,052

(22) Filed: Nov. 15, 2013

(65) Prior Publication Data

US 2014/0218244 A1 Aug. 7, 2014

(30) Foreign Application Priority Data

Feb. 1, 2013 (TW) ..... 102104102 A

(51) Int. Cl.

| | |
|---|---|
| ***H01Q 5/30*** | (2015.01) |
| ***H01Q 21/28*** | (2006.01) |
| ***H01Q 13/10*** | (2006.01) |
| ***H01Q 1/24*** | (2006.01) |

(52) U.S. Cl.

CPC ..... *H01Q 13/10* (2013.01); *H01Q 1/243* (2013.01); *H01Q 5/30* (2015.01); *H01Q 21/28* (2013.01)

(58) Field of Classification Search

CPC ..... H01Q 13/10; H01Q 1/243; H01Q 1/3827; H01Q 5/35; H01Q 5/371

USPC ..... 343/770

See application file for complete search history.

(56) References Cited

U.S. PATENT DOCUMENTS

| | | | | |
|---|---|---|---|---|
| 8,665,164 | B2 * | 3/2014 | Hill | 343/702 |
| 9,041,606 | B2 * | 5/2015 | Faraone | H01Q 1/243 343/702 |
| 2004/0257283 | A1 * | 12/2004 | Asano | H01Q 1/243 343/702 |
| 2007/0152881 | A1 | 7/2007 | Chan | |
| 2010/0123632 | A1 * | 5/2010 | Hill | H01Q 1/243 343/702 |
| 2010/0245197 | A1 | 9/2010 | Kerselaers | |

(Continued)

FOREIGN PATENT DOCUMENTS

| | | |
|---|---|---|
| JP | 2008-104198 A | 5/2008 |
| JP | 2010-068122 A | 3/2010 |
| JP | 2013-005431 A | 1/2013 |

*Primary Examiner* — Dameon E Levi
*Assistant Examiner* — Jennifer F Hu
(74) *Attorney, Agent, or Firm* — Zhigang Ma

(57) ABSTRACT

An antenna assembly includes a base, a ground surface, a first radiating portion, a second radiating portion, a third radiating portion, and a feed portion. The ground surface is arranged on a surface of the base. The feed portion includes a plurality of feed points mounted on the radiating portions. The first radiating portion and one feed point transmit and receive wireless signals at a first frequency band and a second frequency band; the second radiating portion and the third radiating portion couple with the feed points to transmit and receive wireless signals at a third frequency band and a fourth frequency. The first radiating portion, the second radiating portion, and the third radiating portion form several slot antennas. A wireless communication device employing the antenna assembly is also described.

12 Claims, 9 Drawing Sheets

(56) References Cited

U.S. PATENT DOCUMENTS

| | | | | |
|---|---|---|---|---|
| 2012/0223864 | A1* | 9/2012 | Kerselaers | H01Q 1/3275 343/700 MS |
| 2012/0326936 | A1 | 12/2012 | Tu | |
| 2013/0135158 | A1* | 5/2013 | Faraone | H01Q 13/10 343/702 |
| 2013/0141297 | A1* | 6/2013 | Gomme | H01Q 5/35 343/770 |
| 2014/0139379 | A1* | 5/2014 | Bolin | H01Q 9/06 343/702 |

* cited by examiner

ANTENNA ASSEMBLY AND WIRELESS COMMUNICATION DEVICE EMPLOYING SAME

BACKGROUND

1. Technical Field

The present disclosure relates to an antenna assembly and a wireless communication device employing the antenna assembly.

2. Description of Related Art

A wireless communication device uses an antenna assembly to transmit and receive wireless signals at different frequencies for different communication systems. The structure of the antenna assembly is complicated and occupies a large space in the wireless communication device. However, there is limited space for the antenna assembly because of the size limitation of the wireless communication device. Improving a wide frequency band performance of the antenna assembly in the limited space is still an important topic in the art.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure.

Moreover, in the drawings, like reference numerals designate corresponding parts throughout the several views.

DETAILED DESCRIPTION

Figure 1:
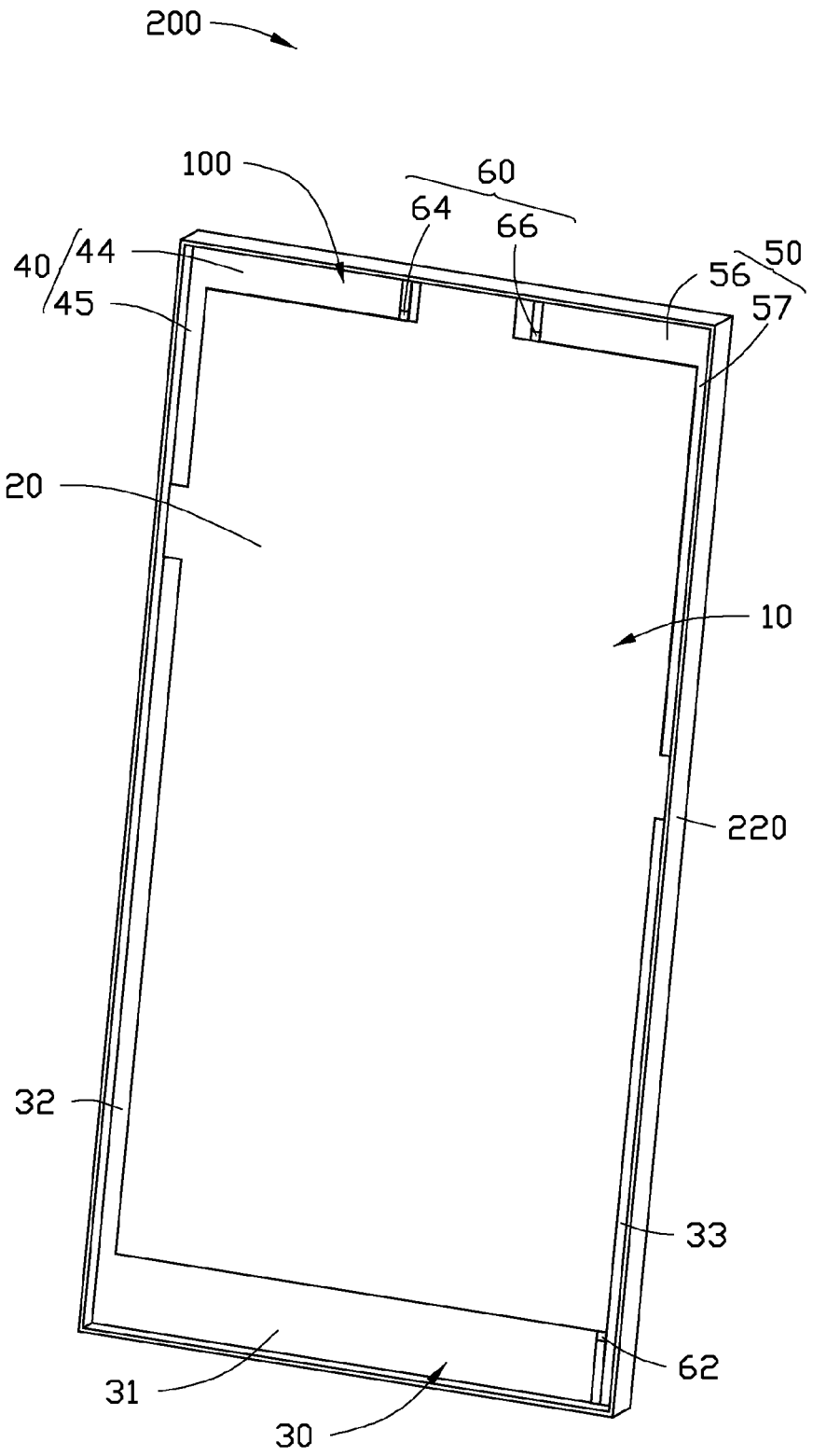
FIG. 1 is an isometric view of a first embodiment of a wireless communication device employing an antenna assembly.

FIG. 1 shows a first embodiment of a wireless communication device 200 employing an antenna assembly 100. The wireless communication device 200 can be a mobile phone or a tablet computer, for example.

Figure 2:
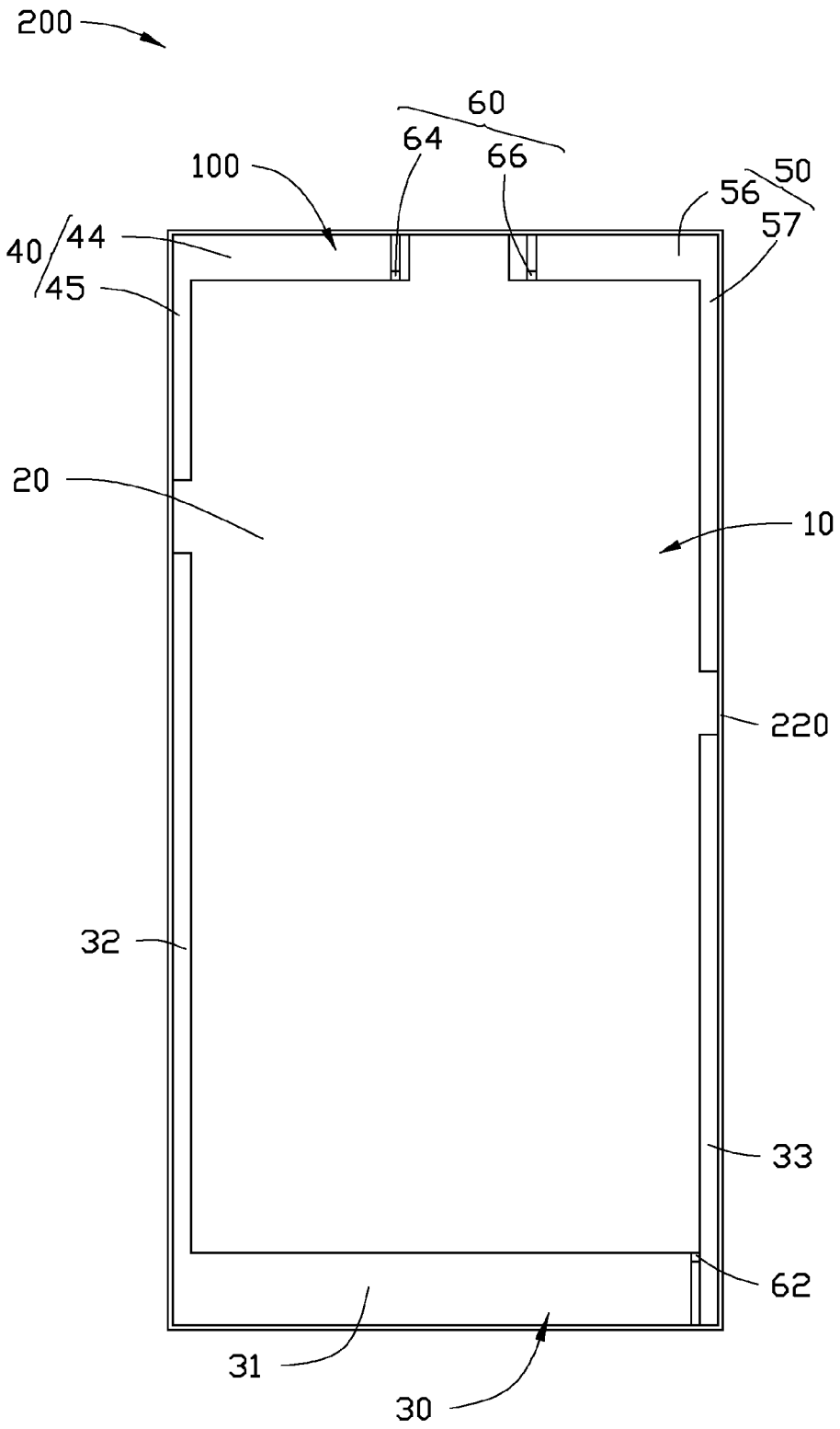
FIG. 2 is a front view of the wireless communication device shown in FIG. 1.

FIG. 2 shows that the antenna assembly 100 includes a base 10, a ground surface 20, a first radiating portion 30, a second radiating portion 40, a third radiating portion 50, and a feed portion 60. The wireless communication device 200 includes a housing 220, which is made of metal material. The housing 220 forms a receiving space (not shown) for receiving the antenna assembly 100.

The base 10 can be made of dielectric material, such as Glass-Fiber-Reinforced Polymer (GFRP). The base 10 is a rectangular plane.

The ground surface 20 is arranged on a top surface of the base 10 for grounding the antenna assembly 100. In one embodiment, the ground surface 20 is a metal conductive layer, such as a copper layer, covering on the base 10. Peripheral edges of the ground surface 20 are electrically connected to the housing 220.

The first radiating portion 30, the second radiating portion 40, and the third radiating portion 50 are formed by cutting out parts of the ground surface 20, and exposing the dielectric material of the base 10, thereby forming a plurality of slot antennas.

The first radiating portion 30 is asymmetric U-shaped and formed along a peripheral edge of the ground surface 20. The first radiating portion 30 includes a first slot section 31, a second slot section 32, and a third slot section 33. In one embodiment, the first slot section 31, the second slot section 32, and the third slot section 33 are substantially planar. The first slot section 31 is defined in a short edge of the ground surface 20, and the second slot section 32 and the third slot section 33 are substantially perpendicularly connected to two opposite ends of the first slot section 31. The second slot section 32 and the third slot section 33 are substantially parallel with each other and extend in a same direction from the first slot section 31. Two connecting points of the first slot section 31 with the second slot section 32 and the third slot section 33 are located at two corners of the ground surface 20. A width of the first slot section 31 is greater than a width of the second slot section 32 and greater than a width of the third slot section 33. A length of the second slot section 32 is greater than a length of the third slot section 33.

The second radiating portion 40 and the third radiating portion 50 are L-shaped and arranged along peripheral edges of the ground surface 20 opposite to the first radiating portion 30. The second radiating portion 40 and the third radiating portion 50 cover the other two corners of the ground surface 20. The second radiating portion 40 includes a fourth slot section 44 and a fifth slot section 45. The fourth slot section 44 is defined in the other short edge of the ground surface 20 opposite to the first slot section 31. The fifth slot section 45 extends substantially perpendicularly from an end of the fourth slot section 44 towards the second slot section 32 and opposite to the second slot section 32. A width of the fourth slot section 44 is greater than a width of the fifth slot section 45.

The third radiating portion 50 includes a sixth slot section 56 and a seventh slot section 57. The sixth slot section 56 is defined in the other short edge of the ground surface 20 opposite to the first slot section 31. The seventh slot section 57 extends substantially perpendicularly from an end of the sixth slot section 56 towards the third slot section 33 and opposite to the third slot section 33. A width of the sixth slot section 56 is greater than a width of the seventh slot section 57. A length of the seventh slot section 57 is greater than a length of the fifth slot section 45.

The feed portion 60 is an elastic piece or a microstrip line. The feed portion 60 includes a first feed point 62, a second feed point 64, and a third feed point 66. The first feed point 62 is mounted on an end of the first slot section 31 near the third slot section 33. The first feed point 62 separates the U-shaped first radiating portion 30 into two parts. When signals feed from the first feed point 62, the signals couple with the first radiating portion 30. The first radiating portion 30 obtains two current paths with different lengths and generate different current signals, which forms a resonance mode of the first radiating portion 30. In the illustrated embodiment, signals that feed from the first feed point 62 transmit on the first slot section 31 and the second slot section 32, thereby generating a low frequency mode. The first feed point 62, the first slot section 31, and the second slot section 32 couple cooperatively to transmit and receive wireless signals with a first frequency band, by adjusting a length and width of the first slot section 31 and the second slot section 32. Thus, the antenna assembly 100 transmits and receives wireless signals, such as GSM 850/900 or WCDMA Band 5/8, at a frequency of about 824 megaHertz (MHz) to about 960 MHz. Signals that feed from the first feed point 62 transmit on the third slot section 33, thereby generating a high frequency mode. The first feed point 62 and the third slot section 33 couple cooperatively to transmit and receive wireless signals with a second frequency band, by adjusting a length and width of the third slot section 33. Thus, the antenna assembly 100 transmits and receives wireless signals, such as GSM 1800/1900 or WCDMA 2100, at a frequency of about 1710 MHz to about 2170 MHz.

The second feed point 64 is mounted on an end of the second radiating portion 40 near the third radiating portion 50. The third feed point 66 is mounted on an end of the third radiating portion 50 near the second radiating portion 40. The second radiating portion 40 achieves large frequency band and high radiating efficiency by adjusting a position of the second feed point 64, thereby adjusting an impedance matching of the second radiating portion 40. The second feed point 64 and the second radiating portion 40 couple cooperatively to transmit and receive wireless signals with a third frequency band. Thus, the antenna assembly 100 transmits and receives wireless signals, such as Wi-Fi, at a frequency of about 2.4 GHz to about 2.485 GHz. The second feed point 64 and the second radiating portion 40 form a Wi-Fi antenna. The third feed point 66 and the third radiating portion 50 couple cooperatively to transmit and receive wireless signals with a fourth central frequency. Thus, the antenna assembly 100 transmits and receives wireless signals, such as GPS, at a central frequency of about 1.575 GHz. The third feed point 66 and the third radiating portion 50 form a GPS antenna.

Figure 3:
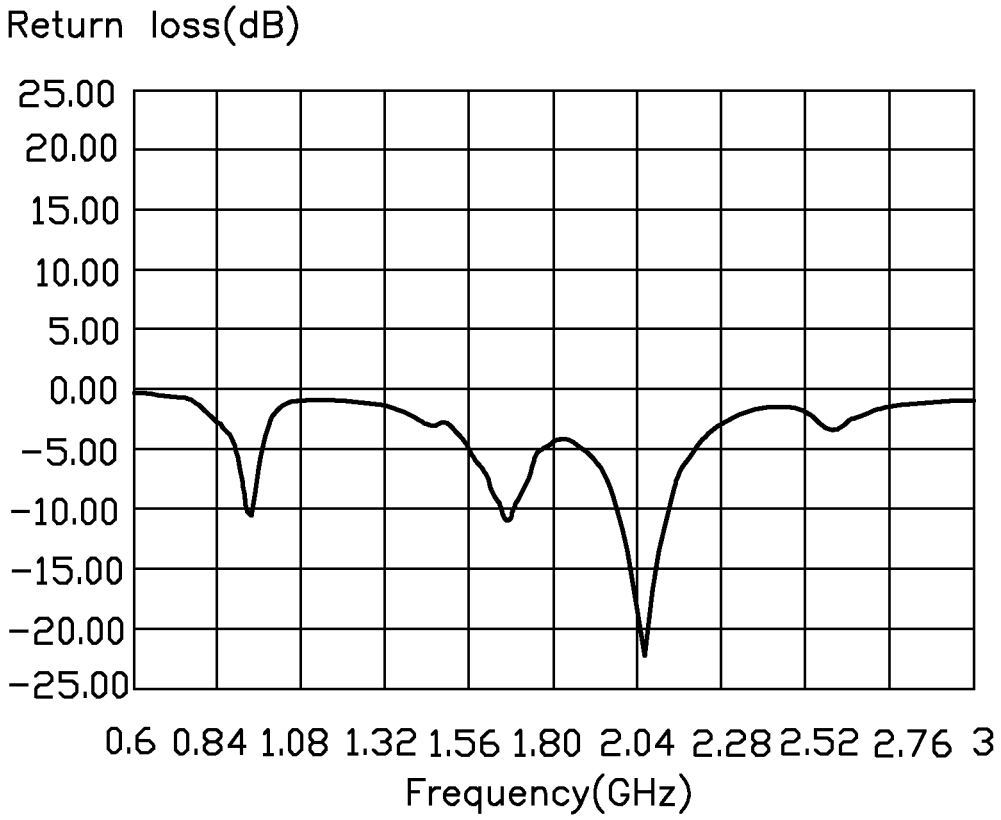
FIG. 3 is a return loss diagram of a first radiating portion of the antenna assembly shown in FIG. 1.
Figure 4:
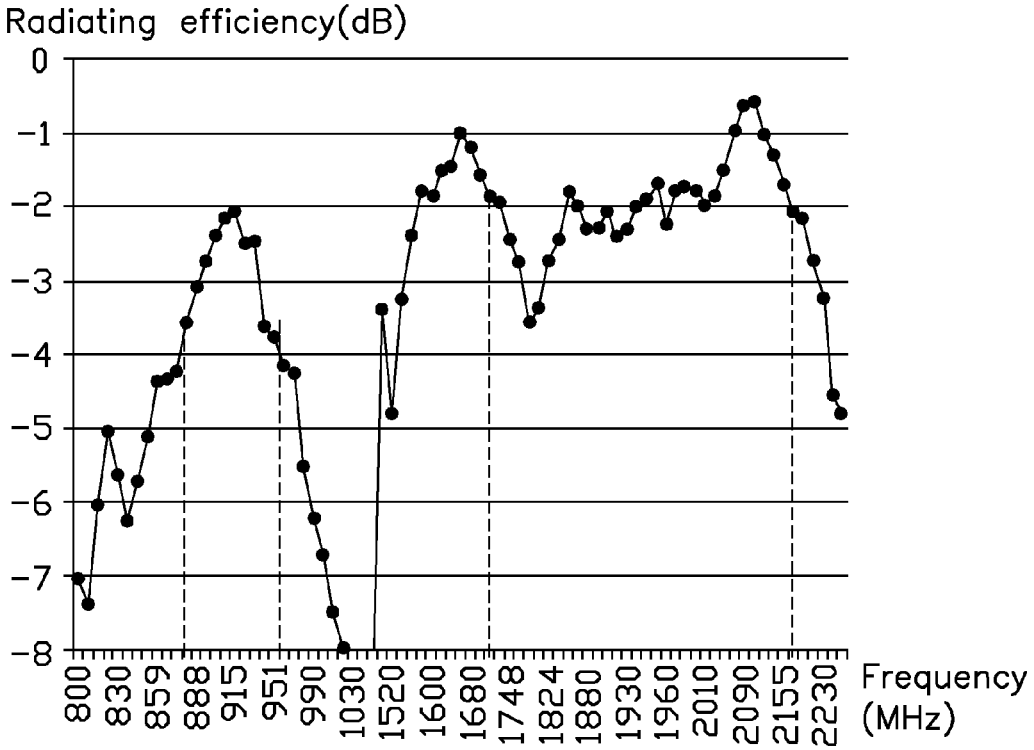
FIG. 4 is a radiating efficiency of the first radiating portion of the antenna assembly shown in FIG. 1.

FIGS. 3 and 4 show that the first radiating portion 30 achieves large frequency band and high radiating efficiency at frequency bands of 824-960 MHz and 1710-2170 MHz. An average radiating efficiency of the first radiating portion 30 at low frequency band is about −4 dB, while at high frequency band is about −2 dB.

Figure 5:
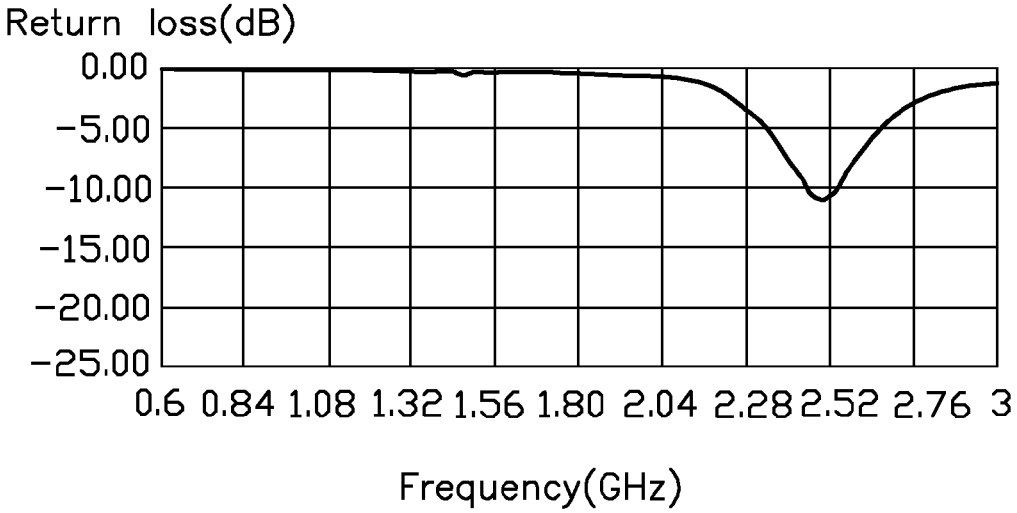
FIG. 5 is a return loss diagram of a second radiating portion of the antenna assembly shown in FIG. 1.
Figure 6:
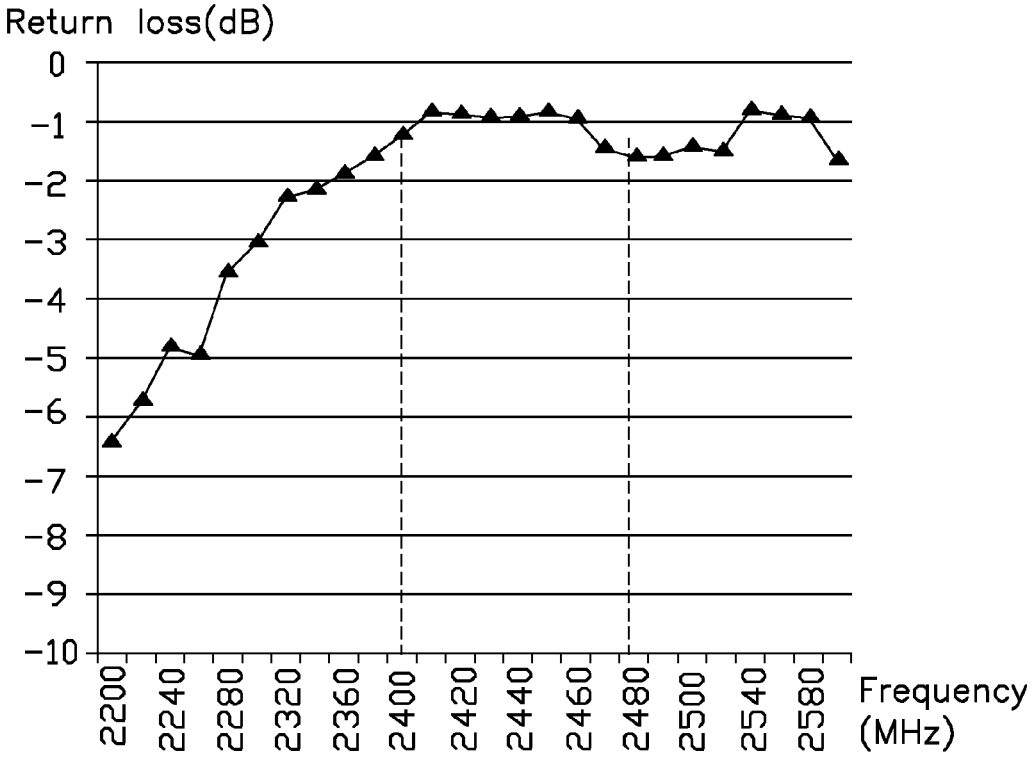
FIG. 6 is a radiating efficiency of the second radiating portion of the antenna assembly shown in FIG. 1.

FIGS. 5 and 6 show that the second radiating portion 40 achieves large frequency band and high radiating efficiency at a frequency band of 2.4-2.485 GHz. An average radiating efficiency of the second radiating portion 40 at the frequency band is about −1 dB.

Figure 7:
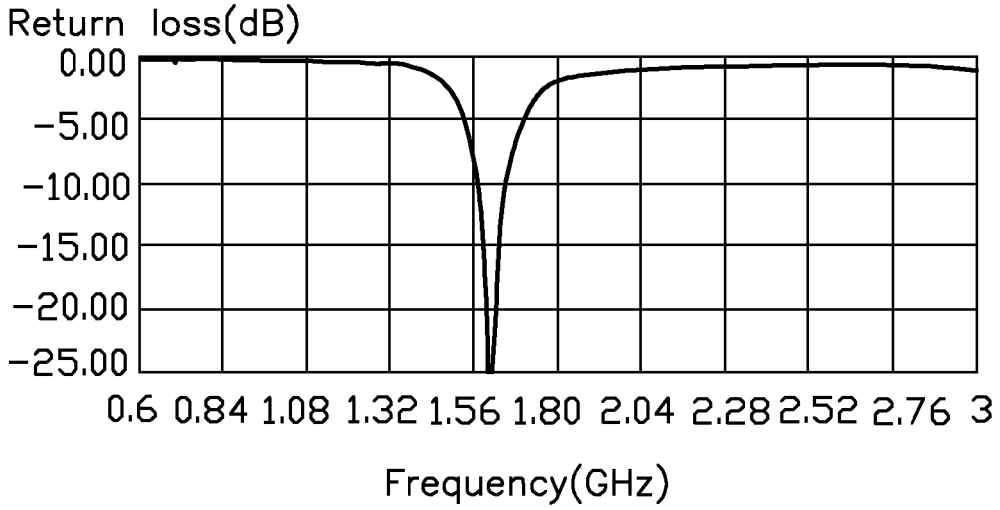
FIG. 7 is a return loss diagram of a third radiating portion of the antenna assembly shown in FIG. 1.
Figure 8:
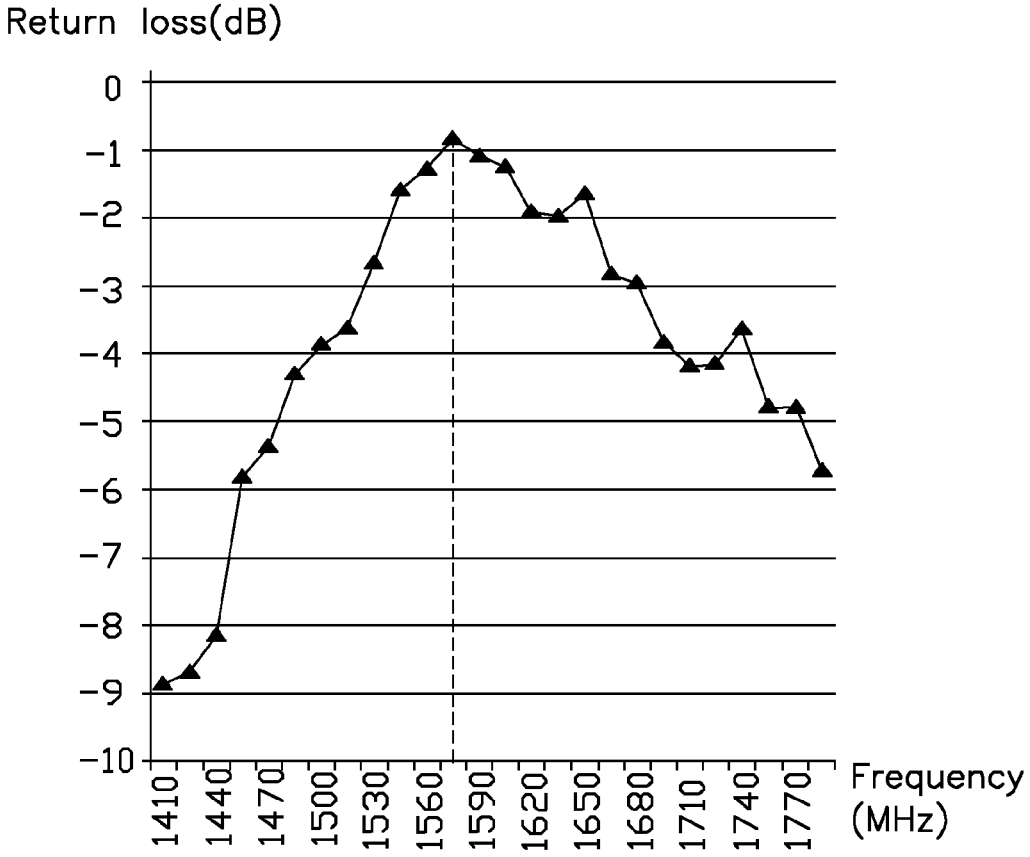
FIG. 8 is a radiating efficiency of the third radiating portion of the antenna assembly shown in FIG. 1.

FIGS. 7 and 8 show that at a central frequency of 1.575 GHz the third radiating portion 50 achieves a large frequency band and a high radiating efficiency. An average radiating efficiency of the third radiating portion 50 at the central frequency is about −1 dB.

Figure 9:
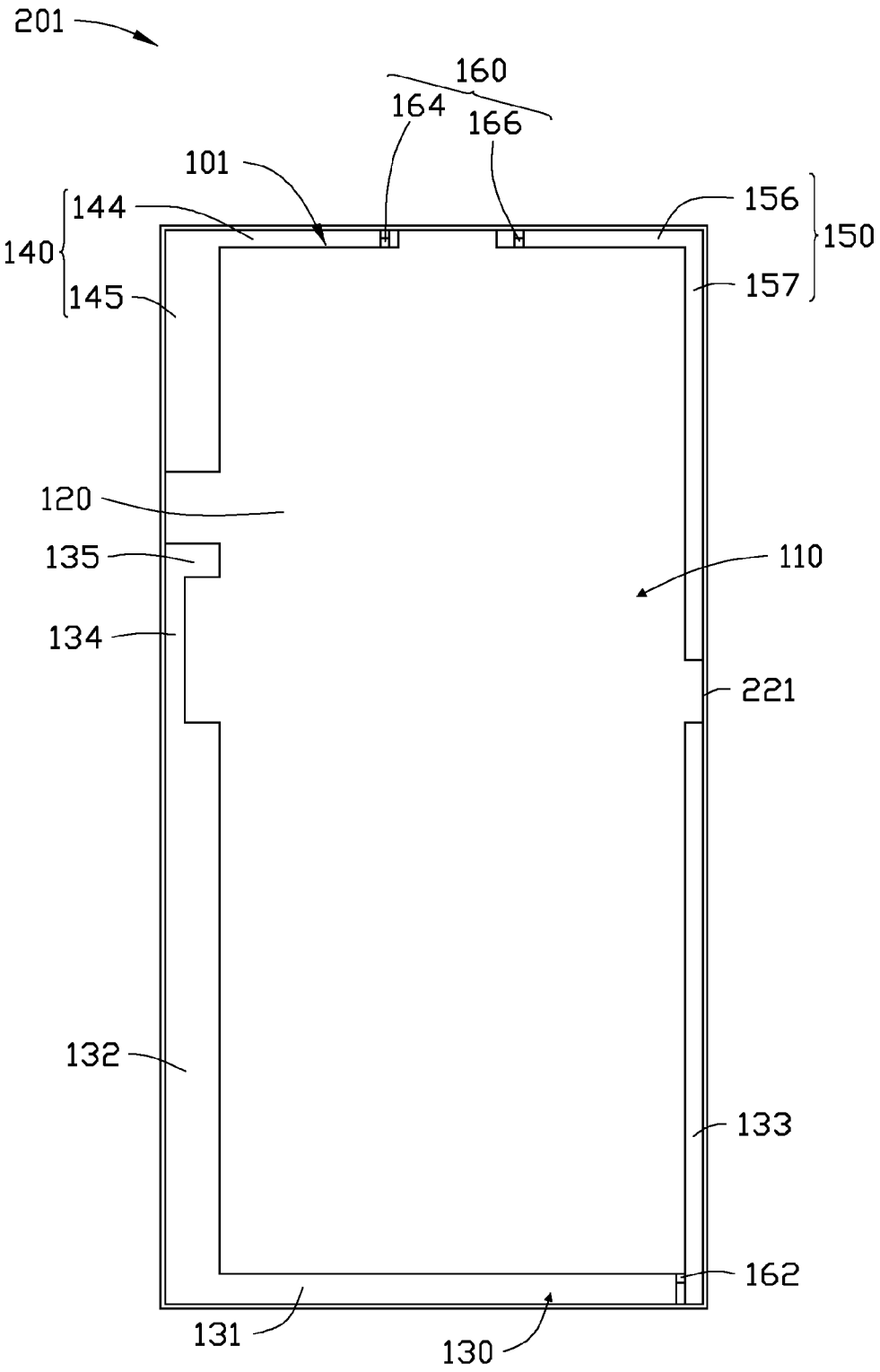
FIG. 9 is a front view of a second embodiment of a wireless communication device employing an antenna assembly.

FIG. 9 shows a second embodiment of a wireless communication device 201 employing an antenna assembly 101. The first radiating portion 130 includes first slot section 131, a second slot section 132, a third slot section 133, a first extending slot section 134, and a second extending slot section 135. A length of the first slot section 131 is shorter than a length of the second slot section 132 and shorter than a length of the third slot section 133, a width of the second slot section 132 is greater than a width of the third slot section 133. The first extending slot section 134 extends from an end of the second slot section 132 away from the first slot section 131 in a same direction as the second slot section 132. A length and a width of the first extending slot section 134 is smaller than a length and a width of the second slot section 132. The second extending slot section 135 extends substantially perpendicularly from an end of the first extending slot section 134 away from the second slot section 132. A length of the second extending slot section 135 is substantially equal to the width of the second slot section 132.

The second radiating portion 140 includes a fourth slot section 144 and a fifth slot section 145. The fifth slot section 145 is aligned with the second extending slot section 135. A width of the fifth slot section 145 is substantially equal to the length of the second extending slot section 135 and is greater than the width of the fourth slot section 144. The third radiating portion 150 includes a sixth slot section 156 and a seventh slot section 157. A width of the sixth slot section 156 is substantially equal to a width of the seventh slot section 157 and the width of the third slot section 133. A length of the seventh slot section 157 is greater than the length of the fifth slot section 145.

The antenna assembly 101 of the second embodiment includes a feed portion 160 having a similar structure as the first embodiment. The feed portion 160 feeds signals and transmits on the first radiating portion 130, the second radiating portion 140, and the third radiating portion 150, to form current paths with different lengths, so that the antenna assembly 101 transmits and receives different wireless signals.

The first radiating portion 30, the second radiating portion 40, and the third radiating portion 50 are formed by cutting out parts of the ground surface 20, and couple cooperatively with the feed portion 60 and employing the base 10, further forming an antenna system with multi-frequency bands. The antenna assembly 100 achieves a wide frequency band for wireless communication devices and occupies little space.

It is believed that the embodiments and their advantages will be understood from the foregoing description, and it will be apparent that various changes may be made thereto without departing from the spirit and scope of the disclosure or sacrificing all of its advantages, the examples hereinbefore described merely being embodiments of the disclosure.

What is claimed is:

1. An antenna assembly, comprising:

a base;

a ground surface arranged on a surface of the base for grounding the antenna assembly;

at least one radiating portion formed by cutting parts of peripheral edges of the ground surface; and a feed portion mounted on the at least one radiating portion and separating the radiating portion into a first radiating section transmitting and receiving wireless signals at a first frequency band and a second radiating section transmitting and receiving wireless signals at a second frequency band, the at least one radiating portion forming a slot antenna;

wherein the radiating portion comprising a first slot section, a second slot section, and a third slot section: the first slot section is defined in an edge of the ground surface, the second slot section and the third slot section extend substantially perpendicularly from opposite ends of the first slot section; the first slot section, the second slot section, and the third slot section form a U-shaped slot antenna;

wherein the at least one radiating portion further includes a first extending slot section and a second extending slot section; the first extending slot section extends from an end of the second slot section away from the first slot section in a same direction of the second slot section, the second extending slot section extends substantially perpendicularly from an end of the first extending slot section away from the second slot section; a length and a width of the first extending slot section are smaller than a length and a width of the second slot section, a length of the second extending slot section is substantially equal to the width of the second slot section.

2. The antenna assembly as claimed in claim 1, wherein the base is made of dielectric material, the ground surface is a metal conductive layer covering the base, and the radiating portion is formed by cutting out the metal conductive layer of the ground surface and exposing the dielectric material of the base.

3. The antenna assembly as claimed in claim 1, wherein the feed portion is mounted on an end of the first slot section near the third slot section; the feed portion, the first slot section, and the second slot section form the first radiating section; the feed portion and the third slot section form the second radiating section.

4. The antenna assembly as claimed in claim 3, wherein the first frequency band is adjustable by adjusting a length and a width of the first slot section and the second slot section; the second frequency band can be adjusted by adjusting a length and a width of the third slot section.

5. An antenna assembly, comprising:

a base;

a ground surface arranged on a surface of the base for grounding the antenna assembly;

a first radiating portion, a second radiating portion, and a third radiating portion formed by cutting parts of peripheral edges of the ground surface; and a feed portion including a plurality of feed points mounted on the first radiating portion, the second radiating portion, and the third radiating portion the feed portion includes a first feed point, a second feed point, and a third feed point;

wherein the first feed point separates the first radiating portion into a first radiating section transmitting and receiving wireless signals at a first frequency band and a second radiating section transmitting and receiving wireless signals at a second frequency band, the second radiating portion couples with the second feed point and transmits and receives wireless signals at a third frequency band; the third radiating portion couples with the third feed point and transmits and receives wireless signals at a fourth frequency, the first radiating portion, the second radiating portion, and the third radiating portion forming several slot antennas;

wherein the first radiating portion includes a first slot section, a second slot section, and a third slot section: the first slot section is defined in an edge of the ground surface: the second slot section and the third slot section extend substantially perpendicularly from opposite ends of the first slot section; the first slot section, the second slot section, and the third slot section form a U-shaped slot antenna and cover two corners of the ground surface: a width of the first slot section is greater than a width of the second slot section and greater than a width of the third slot section, a length of the second slot section is greater than a length of the third slot section;

wherein the second radiating portion includes a fourth slot section and a fifth slot section; the fourth slot section is defined in the other edge of the ground surface opposite to the first slot section; the fifth slot section extends substantially perpendicularly from an end of the fourth slot section towards the second slot section and opposite to the second slot section; the fourth slot section and the fifth slot section form a first L-shaped slot antenna and first corner a corner of the ground surface, a width of the fourth slot section is greater than a width of the fifth slot section;

wherein the third radiating portion includes a sixth slot section and a seventh slot section, and the sixth slot section is defined in the same edge of the ground :surface with the fourth slot section, the seventh slot section extends substantially perpendicularly from an end of the sixth slot section towards the third slot section and opposite to the third slot section; the sixth slot section and the seventh slot section form a second L-shaped slot antenna and cover a second corner of the ground surface; a width of the sixth slot section is greater than a width of the seventh slot section, a length of the seventh slot section is greater than a length of the fifth slot section.

6. The antenna assembly as claimed in claim 5, wherein the base is made of dielectric material, the ground surface is a metal conductive layer covering the base, and the first radiating portion, the second radiating portion, and the third radiating portion are formed by cutting out the metal conductive layer of the ground surface and exposing the dielectric material of the base.

7. The antenna assembly as claimed in claim 6, wherein the first feed point is mounted on an end of the first slot section near the third slot section; the first feed point, the first slot section, and the second slot section form the first radiating section; the first feed point and the third slot section form the second radiating section; the second feed point is mounted on an end of the fourth slot section opposite to the sixth slot section; the third feed point is mounted on an end of the sixth slot section opposite to the fourth slot section.

8. The antenna assembly as claimed in claim 7, wherein the first radiating portion further includes a first extending slot section and a second extending slot section, the first extending slot section extends from an end of the second slot section away from the first slot section in a same direction of the second slot section; the second extending slot section extends substantially perpendicularly from an end of the first extending slot section away from the second slot section.

9. The antenna assembly as claimed in claim 7, wherein the first radiating portion transmits and receives wireless signals at a low frequency band of 824-960 MHz and a high frequency band of 1710-2170 MHz, the second radiating portion transmits and receives wireless signals at a third frequency band of 2.4-2.485 GHz, and the third radiating portion transmits and receives wireless signals at a fourth central frequency of 1.575 GHz.

10. A wireless communication device, comprising:

housing made of metal material; and an antenna assembly received in the housing and comprising:

a base;

a ground surface arranged on a surface of the base for grounding the antenna assembly, the ground surface including peripheral edges electrically connected to the housing;

a first radiating portion, a second radiating portion, and a third radiating portion formed by cutting parts of peripheral edges of the ground surface; and a feed portion including a plurality of feed points mounted on the first radiating portion, the second radiating portion, and the third radiating portion, the feed portion includes a first feed point, a second feed point and a third feed point;

wherein the first feed point separates the first radiating portion into a first radiating section transmitting and receiving wireless signals at a first frequency band and a second radiating section transmitting and receiving wireless signals at a second frequency band, the second radiating portion couples with the second feed point and transmits and receives wireless signals at a third frequency band; the third radiating portion couples with the third feed point and transmits and receives wireless signals at a fourth frequency; the first radiating portion, the second radiating portion, and the third radiating portion forming several slot antennas;

wherein the first radiating portion includes a first slot section, a second slot section, and a third slot section: the first slot section is defined in an edge of the ground surface: the second slot section and the third slot section extend substantially perpendicularly from opposite ends of the first slot section; the first slot section, the second slot section, and the third slot section form a U-shaped slot antenna and cover two corners of the ground surface; a width of the first slot section is greater than a width of the second slot section and greater than a width of the third slot section, a length of the second slot section is greater than a length of the third slot section;

wherein the second radiating portion includes a fourth slot section and a fifth slot section; the fourth slot section is defined in the other edge of the ground surface opposite to the first slot section; the fifth slot section extends substantially perpendicularly from an end of the fourth slot section towards the second slot section and opposite to the second slot section; the fourth slot section and the fifth slot section form a first L-shaped slot antenna and cover a first corner of the ground surface, a width of the fourth slot section is greater than a width of the fifth slot section;

wherein the third radiating portion includes a sixth slot section and a seventh slot section, and the sixth slot section is defined in the same edge of the ground surface with the fourth slot section, the seventh slot section extends substantially perpendicularly from an end of the sixth slot section towards the third slot section and opposite to the third slot section; the sixth slot section and the seventh slot section form a second L-shaped slot antenna and cover a second corner of the ground surface; a width of the sixth slot section is greater than a width of the seventh slot section, a length of the seventh slot section is greater than a length of the fifth slot section.

11. The wireless communication device as claimed in claim 10, wherein the base is made of dielectric material, the ground surface is a metal conductive layer covering the base, and the first radiating portion, the second radiating portion, and the third radiating portion are formed by cutting out the metal conductive layer of the ground surface and exposing the dielectric material of the base.

12. The wireless communication device as claimed in claim 11, wherein the first feed point is mounted on an end of the first slot section near the third slot section; the first feed point, the first slot section, and the second slot section form the first radiating section; the first feed point and the third slot section form the second radiating section; the second feed point is mounted on an end of the fourth slot section opposite to the sixth slot section; the third feed point is mounted on an end of the sixth slot section opposite to the fourth slot section.

* * * * *